US005101838A

United States Patent [19]

Schwartz et al.

[11] Patent Number: 5,101,838

[45] Date of Patent: Apr. 7, 1992

[54] ARTICLE FOR SIMULATION OF SMOKING

[75] Inventors: Hermann Schwartz, Pfäffikon; Max Burger, Burg, both of Switzerland

[73] Assignee: Burger Soehne AG Burg, Burg, Switzerland

[21] Appl. No.: 422,660

[22] Filed: Oct. 17, 1989

[30] Foreign Application Priority Data

Oct. 19, 1988 [CH] Switzerland ..... 03895/88

[51] Int. Cl.[5] ..... A24D 1/00

[52] U.S. Cl. ..... 131/273; 131/335; 131/337

[58] Field of Search ..... 131/273, 335, 337

[56] References Cited

U.S. PATENT DOCUMENTS 4,813,437 3/1989 Ray ..... 131/273

*Primary Examiner*—V. Millin

[57] ABSTRACT

With the article, smoking is simulated by inhalation of nicotine without the action of heat. A carrier device (14), for example, a packing of spheres (20), for a nicotine preparation capable of volatilizing at room temperature is incorporated in a container (10) with air inlet (11) and air outlet (12). The carrier device (14) forms a plurality of uninterrupted flow channels (21). The nicotine preparation (e.g., pure nicotine) is applied on the free and nonabsorbent surface of the carrier as a thin layer (22) leaving the channels (21) open. Glass of other sufficiently impervious, inert materials, metals or metal alloys, such as aluminum, dense or glazed ceramics, or especially dense plastics such as polytetrafluoroethylene or polybutyleneterephthalate come into consideration as the material for the carrier device (14). Various shapes of carrier devices are described.

31 Claims, 2 Drawing Sheets

Fig. 1A
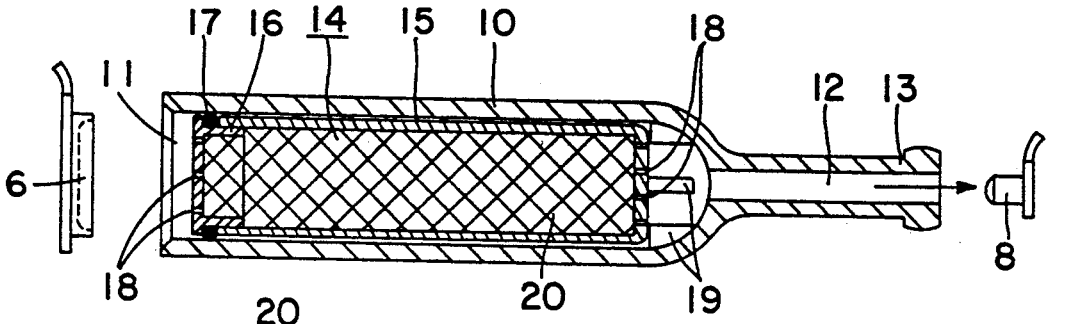
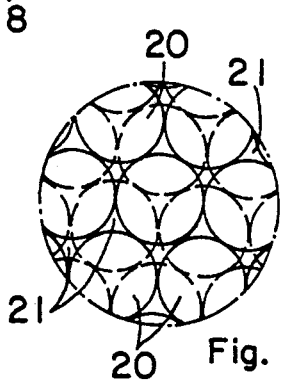
Fig. 1B
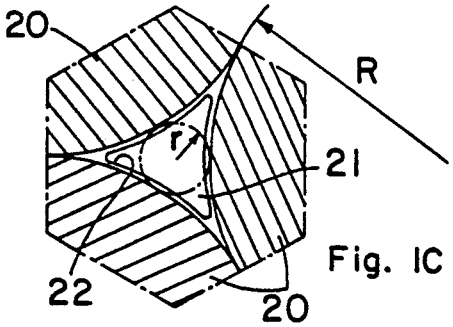
Fig. 1C
Fig. 2A
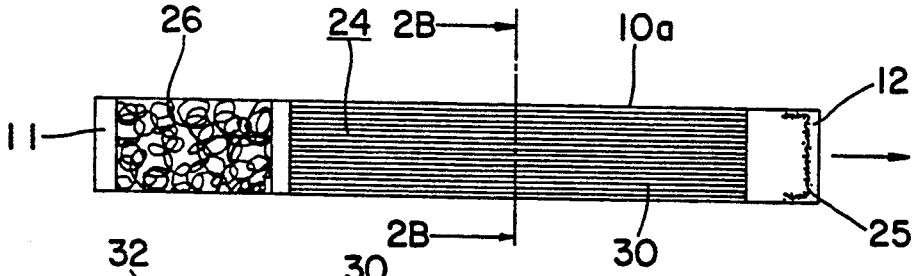
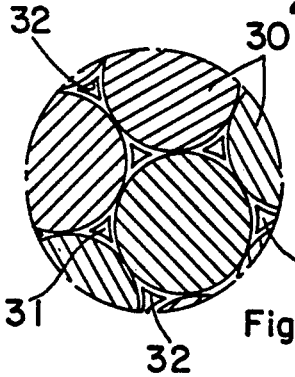
Fig. 2B Fig. 3A
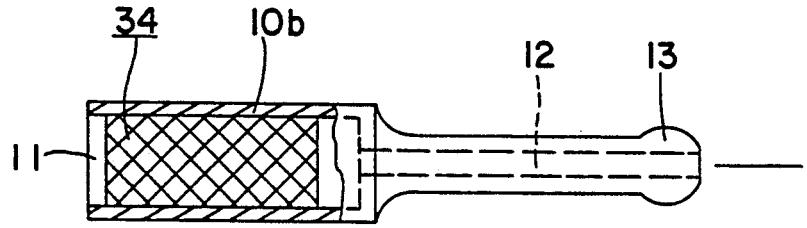
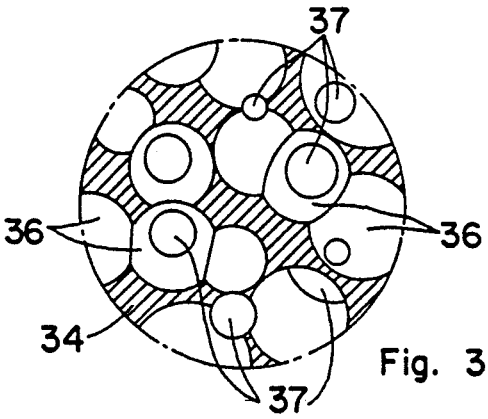
Fig. 3B
Fig. 4
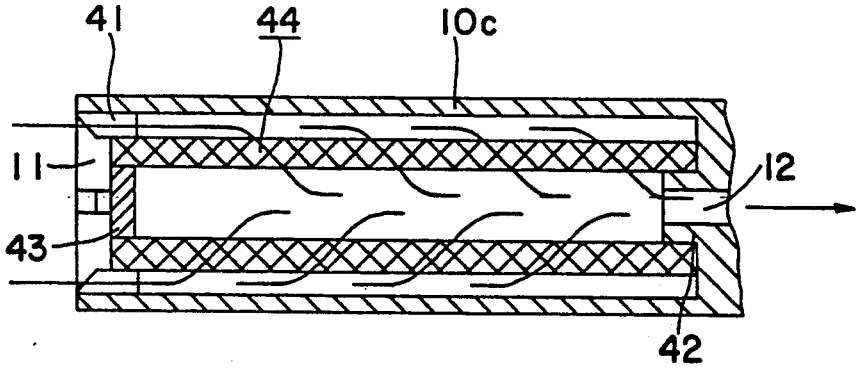

ARTICLE FOR SIMULATION OF SMOKING

BACKGROUND OF THE INVENTION

The invention concerns an article for simulation of smoking by inhalation of nicotine without action of heat. The article has a container defining openings for the intake and discharge of air and contains a carrier device internally which receives a nicotine preparation capable of volatilizing at room temperature.

It is generally known that a nicotine dose is received during smoking of tobacco and exerts a stimulating action expected by the smoker. However, a Production of many toxic materials is associated with the combustion of tobacco, particularly With the very widespread smoking of cigarettes. Such toxic materials—there is a differentiation between gaseous and particulate materials—reach not only the actual smoker in the main stream of the smoke, but also can reach the environment where it can annoy the so-called "passive smoker" from the secondary smoke stream Which originates from the glowing cigarette.

Since nicotine absorption in limited amounts alone or possibly in combination with flavoring materials is scarcely regarded as decidedly injurious to health, attempts have been made to permit a stimulating nicotine absorption without the combustion of tobacco necessarily linked with smoking. In addition to omission of all toxic materials of smoke, this would simultaneously eliminate any problems of passive smoking in addition to burn injuries, hygienic impairments by tar, etc.

A "smoker's" article of the initially mentioned type for simulated smoking has been disclosed in U.S. Pat. No. 4,284,089. According to that proposal, the tubular container as nicotine carrier device contains an absorbent composition (e g., a roll of filter paper) with a central longitudinal passageway, which is tapered at both ends. The absorbent composition is saturated with a liquid nicotine preparation. by drawing of air through the longitudinal passageway, nicotine liquid will volatilize as a result of the Venturi effect and thus can be inhaled. Since in this arrangement, the absorbent composition (such as a wick) is saturated with liquid, a considerable nicotine quantity of approximately 300 mg is a necessary charge, i.e. a multiple of the human lethal dose. In addition, nicotine during successive puffs of air must be extracted continuously by capillary action from the inside of the carrier material to the passageway surface; this process requires an appreciable time and causes the nicotine quantity absorbed per puff to decrease rapidly with successive puffs at time intervals customary for inhaling—a result which is opposite to that of normal smoking. A modification of the aforementioned arrangement is described in European Patent A 0149,997. In this case, "insulating" sections in the container are arranged linearly beside each other, in alternating fashion with nicotine-bearing sections to define a longitudinal Passageway. Of course, it is difficult to understand how a drastic reduction of the nicotine charging amounts to the reported "-30 mg" (with comparable nicotine release) will be achieved in this manner, since a statement of the nicotine amounts obtained per puff is lacking in that publication.

European Patent A 0,202,512, in turn, describes a "smoker's" article of the initially mentioned type in which on one hand an increased release of nicotine per puff is the goal, particularly with effective volatilization to prevent nicotine from being entrained in droplet form during intake of air. This is achieved by a porous plug of polymerized material in which nicotine is effectively absorbed i.e. embedded inside between molecular polymer chains. Nicotine release is then accomplished by desorption from the material while drawing in air. Such absorption and desorption processes of course, as is known, Proceed extremely slowly; this also is confirmed in the cited publication. A period of several days or 1 week is required for charging samples of polypropylene with a few weight Percent of nicotine by steeping them in pure nicotine (strongly temperature-dependent). On the other hand, the low nicotine release proceeds extremely slowly and can extend over several thousands puffs, which naturally is not practical considering the customary habits of smokers. Also, mass production of such articles is problematical since correspondingly a number of dipping baths containing highly toxic pure nicotine are necessary for charging the porous plugs during the long absorption time. After the dipping treatment, the nicotine adhering to the plugs must be washed off and the wash liquid containing nicotine finally must be disposed of. Additional chemical interactions between the plug material (plastic) and the nicotine absorbed therein, at least with extended storage times, are not excluded for the finished product.

SUMMARY OF THE INVENTION

In the present invention, the disadvantages inherent to the aforementioned, known product proposals are overcome. A principal object of the invention is to provide an article for "smokeless" nicotine inhalation suitable for large scale manufacture, which by introduction of acceptable amounts of nicotine preparation permits suitable nicotine amounts to be metered out during successive puffs which correspond approximately to the customary smoking processes.

The preceding object is achieved according to the invention in that the carrier device, receiving the nicotine preparation and essentially filling up the effective cross section of the container, forms a plurality of uninterrupted flow channels on whose free and nonabsorbent surface the nicotine preparation is applied as a thin layer leaving the channels open.

In this manner, the nicotine preparation is exposed to the air being drawn through as a thin film on a relatively large free surface which corresponds for all purposes to the surface of a "labyrinth" of channels. Also it is essential in this case that the material of the carrier device adheres tightly at least at the surface of the channels, i.e. is impermeable for the nicotine preparation and thus the preparation only adheres by adhesion (wetting), however does not penetrate into the surface by absorption. Also, the preparation by no means will fill up the flow channels, but rather will leave these open for air flow. Therefore, hardly any capillary action occurs (always in small degrees on projecting corners of the channel cavities), and no "secondary flowing" or "secondary diffusing" of the preparation is accomplished within the carrier during volatilization; the effective, wetted volatilization surface thus for practical purposes remains unchanged and the layer is removed during inhalation uniformly in successive puffs. Also, the charging of air With volatilized nicotine is practically independent of the time intervals between the successive puffs, since no "depletion" of the volatilization surface occurs.

The object of the invention naturally permits its preparation in a variety of embodiments. Thus, the container can correspond essentially to the shape of a cigarette, however other designs are completely conceivable, e.g., similar to a pipe, etc. In particular, different model forms for the carrier device are to be taken into consideration, thus, for example a (loose) packing of a granulate, e.g. of spheres, a bundle of parallel rods, an open-pored sintered object (frit), a solid, open-celled foam, etc. Glass, because of its imperviousness, low price, neutral taste and chemical stability, is regarded as a particularly suitable material for the carrier device; nevertheless, other materials also come into consideration, such as aluminum or other metals, glazed or impervious ceramics, certain impervious plastics such as polytetrafluoroethylene (Teflon), etc. The introduction of the required small amounts of nicotine preparation in the carrier device can be accomplished by application of a measured volume of the preparation on the outside surface after which, due to good wetting, the liquid spreads out relatively rapidly over the channel surfaces into the inside of the device. E.g., pure nicotine and further preparations known per se, such as, e.g. those reported in the above publications cited as state of the art and also in European Patent A 0,148,749, (incorporated by reference) are suitable as the nicotine preparation. Possibly, desired flavoring materials, such as tobacco taste, fruit flavors, mint, etc. either can be admixed into the nicotine preparation or can be added separately in the container, e g in an element similar to a filter or as a "capsule", etc.

Special, preferred embodiments of the article according to the invention are recited in patent claims 2 to 17. For manufacture of the article, the nicotine preparation can either be added to the carrier device found in the container or the carrier device can he charged with nicotine preparation in an earlier production step and be inserted subsequently into the container. Therefore, the invention also relates to the prepared carrier device itself as a preliminary product.

BRIEF DESCRIPTION OF THE DRAWINGS

Various embodiments of the article according to the present invention and their method of operation and properties are explained in more detail below with respect to the drawings.

FIG. 1 (A–C) shows a first embodiment in longitudinal section with a carrier device in the form of spherical granules one section of which has been depicted enlarged at two levels of magnification;

FIG. 2 (A and B) is the longitudinal section of a second embodiment with a bundle of longitudinal rods as a carrier device, with a portion of the cross section along the inserted section line enlarged;

FIG. 3 (A and B) shows a third embodiment schematically with an open-celled, rigid foam object as the carrier device, of which one portion is enlarged and represented in section; and FIG. 4 is a partial representation of an additional embodiment in longitudinal section, with a carrier device in the form of a porous tube.

DESCRIPTION OF THE PREFERRED EMBODIMENTS

The article for simulation of smoking according to the embodiment of FIG. 1 comprises a container 10 made, e.g. of plastic, which incorporates a mouthpiece 13. The air intake opening 11 of container 10 and the air delivery opening designed as passageway 12 in mouthpiece 13 can, if necessary, be sealed, e.g. during storage of the finished article, by a cover 6 or a plug 8, both, e.g. of soft plastic. A carrier device, designated generally 14, which receives a nicotine preparation capable of volatilizing at room temperature, is arranged inside container 10 as described in more detail below. The carrier device 14 in the present case comprises a cylindrical container 15 with cover 16 and is inserted in container 10 from the air intake opening 11 and against the axial mounting on stop ribs 19. A number of passageways 18 are Provided in cover 16 and on the bottom of container 15 for the passage of air. A gasket 17 inserted between container 15 and cover 16 seals the carrier device 11 within the container. The carrier device essentially occupies the effective cross section of container 10. In this manner, the air which is drawn through opening 11 during inhaling is forcibly induced to flow through the inside of container 15.

Container 15 of carrier device 14 is essentially filled with a granular packing—in the present example, glass spheres of identical diameter. This granular packing—it can also represent a packing of irregularly shaped granules or spheres of varying diameter—forms the active section of carrier device 14. It is essential that a plurality of uninterrupted flow channels are formed in the carrier device for the air drawn in during inhaling. (The channels in this case are formed by means of intervening spaces linked with each other between the granular grains or spheres). A nicotine preparation capable of volatilizing at room temperature is added to the carrier device as a thin layer on the free surface of these channels in such manner that the channels remain open. Also it is essential that the active section of the material forming the carrier device be at least impervious on its surface, i.e. the added nicotine preparation is not absorbed. It has been established that—with an appropriately coated surface of the flow channels—it is possible with such a arrangement to draw through air at room temperature and to volatilize a sufficient amount of nicotine with each puff so that the stimulating action of smoking is simulated. Since there is no absorption, the nicotine deposited on the surface remains exposed continuously to air and even with the small nicotine charges, it is possible to coat a relatively large surface of the carrier device. This will be illustrated with reference to FIG. 1 by the following quantitative considerations.

A random area of the spherical packing is depicted enlarged in FIG. 1 and designated by A (for simplicity, in two layers as uniform, very dense sphere packing). In this case, spheres 20 and the intervening spaces 21 existing between them and forming the plurality of uninterrupted flow channels are visible beside and above one another. Then, once more a partial section of the view A is depicted enlarged in view B. In view B in section the three spheres 20 are touching each other and, the intervening space or flow channel 21 is formed by them. In the greatly enlarged view B, the thin layer 22 of the nicotine preparation added to the sphere surface is also visible (layer thickness not to scale, but rather is depicted larger than actuality). In addition, the included circle with the radius r contacting the three spheres 20 with the radius R is drawn in the intervening space 21 with a dotted line. It can be shown by simple calculation that the ratio R:r=0.1547 . . . .

For the following calculations introduced as examples, it is assumed that a container 15 with an inside diameter of 7.5 mm and a length (inside) of 30 mm is filled with glass spheres 20 of identical size to form the carrier device 14. (In this case there is a small amount of play between the spheres and the container wall, and the spheres are packed loosely above each other.) The number of spheres which fit the space within the container were determined empirically for several spherical radii R. It is somewhat lower than with the theoretical, most dense spherical packing. Then, the carrier device is charged with a fixed amount of liquid nicotine preparation (specific gravity of pure nicotine = 1 for practical purposes, i.e. 1 mg = 1 $mm^3$), and the resulting thickness of layer 22 is calculated by assuming uniform distribution of the liquid over the entire surface of the spheres. This layer thickness then can be compared to the radium r of the included circle (FIG. 1, B) with given sphere radium R. The following table 1 depicts ratios for three different sphere sizes with a constant charge of 6 $mm^3$ of preparation (6 mg pure nicotine):

TABLE 1

| sphere circle radius R [mm] | number of spheres | total sphere surface [$mm^2$] | layer thickness [μm] | included radius r [μm] |
|---|---|---|---|---|
| 1.5 | 52 | 1470 | 4.1 | 232 |
| 1.2 | 98 | 1773 | 3.4 | 186 |
| 1 | 171 | 2149 | 2.8 | 155 |
| 0.75 | 434 | 3068 | 1.9 | 116 |

Several important facts can be recognized from the geometric ratios calculated as example:

The thickness of layer 22 amounts to just a small fraction of the included circle radius r (approximately 1/50 or 1/60). On the one hand, this means that the cross section of channels 21 remains wide open and, on the other hand, that the capillary action on the liquid layers is low, i.e., is limited to the vicinity of the contact Points (i.e. to smaller areas than depicted in FIG. i B, since the layer thickness is exaggerated in the drawing). Also these ratios basically do not change, e.g., when the nicotine loading amount is halved or doubled in comparison to the assumed 6 mg. It can be concluded from this that the "labyrinth" of flow channels 21 exhibits a quite large, free volatilization surface which, although it does not correspond to the total sphere surface (Table 1), it still approaches this. When air is drawn through channels 21 during use of this article, a part of the nicotine on this completely wetted surface volatilizes and then is inhaled with the air. Since the size of the volatilization surface changes only very little during a large number of successive puffs, the layer 22 is only gradually reduced in thickness.

Experiments were carried out in an arrangement according to FIG. 1 (however with somewhat different size proportions than used as basis for Table 1) to determine the inhalable nicotine amounts volatilized by drawing air through at room temperature. A container 15 with 9.2 mm inside diameter and 24 mm length was filled with 63 glass spheres of 3 mm diameter in a loose packing. The sphere packing was then loaded with 12.8 mg (for all practical purposes, 12.8 $mm^3$); this was distributed uniformly in a short time over the entire 1781 $mm^2$ sphere surface by slight shaking of the spheres. The resulting, calculated thickness of the nicotine layer 22 amounts to 7.2 μm, with an included circle radius of 232 μm.

The article prepared in this manner was now "smoked" with dry air by drawing air amounts of 35 ml volume each of approximately a two second duration through the carrier device 14 at time intervals of approximately 60 seconds. After 50 puffs, the weight decrease of the carrier device 14 was then determined by precise weighing and from this the average nicotine release per puff was calculated. The following Table 2 depicts the measured results over 550 puffs:

TABLE 2

| | (nicotine loading 12.8 mg) number puffs | | | | | | | | | | |
|---|---|---|---|---|---|---|---|---|---|---|---|
| | 50 | 100 | 150 | 200 | 250 | 300 | 350 | 400 | 450 | 500 | 550 |
| weight decrease after 50 puffs [mg] | 1 | 1 | 1 | 0.9 | 0.9 | 0.9 | 0.8 | 0.8 | 0.7 | 0.7 | 0.6 |
| average nicotine release per puff [μg] | 20 | 20 | 20 | 18 | 18 | 18 | 16 | 16 | 14 | 14 | 12 |
| total weight decrease [mg] | 1 | 2 | 3 | 3.9 | 4.8 | 5.7 | 6.5 | 7.3 | 8.0 | 8.7 | 9.3 |

On basis of these results it can be established with the articles described as examples that the volatilization at room temperature yields very noteworthy amounts of nicotine "appropriate" for inhalation, even if for practical reasons not more than probably 50 or 100 puffs are to be taken into consideration. Initially, the nicotine release is constant and relatively high. After 350 puffs, ca. 50%, and after 550 puffs, just over 70% of the nicotine charge has volatilized. That the nicotine release per puff still amounts to 80% of the initial release after "consumption" of 50% of the original charge (350 puffs) can be taken as confirmation of the fact that over a long period the effective volatilization surface remains almost constant and layer 22 decreases only in its thickness. That finally, after approximately 80% weight decrease, the nicotine released per puff drops off rapidly (not contained in Table 2) can be explained by the fact that the layer 22 finally is depleted at isolated Points and then is completely exhausted in increasingly expanding areas; the experiment was stopped after 950 puffs with only 8% residual nicotine.

A further embodiment of an article for simulation of smoking is depicted in FIG. 2 and described below. This article comprises a container 10*a* in the form of a tube, e.g. with approximate dimensions of a cigarette, with an air intake opening 11 and air delivery opening 12. The carrier device 24 for a nicotine preparation in this case is constructed as a bundle of parallel longitudinal rods 30 of nonabsorbent material; preferably, the rods 30, as is apparent from the enlarged section c, have a circular cross section with the intervening spaces existing between them forming a Plurality of flow channels 31 for the air drawn through. Obviously, rods 30 also can exhibit a different, e g., irregular, cross section, as long as they leave the intervening spaces open for the formation of flow channels. An air-permeable barrier 25, for example in the form of a wire screen, can be inserted in the tube at the air delivery end 12 in order to Prevent the emergence of individual rods 30. Tube 10*a*, e.g., can be rolled from several paper layers or can be prepared from thin cardboard; suitably, an impermeable inside coating, e.g. aluminum foil, is applied so that the nicotine preparation received by the carrier device 24 does not diffuse out into the material of tube 10*a*.

A nicotine preparation capable of volatilizing at room temperature is applied on the nonabsorbent surface of rods 30—e.g., these can be glass rods—as a thin layer 32 which leaves the flow channel 31 open. In FIG. 2 C, the layer 32 is depicted slightly thicker than actuality in comparison to the diameter of rods 30 merely in order to represent them better.

In order to formulate a proposal for the possible geometric conditions for a carrier device 24 according to FIG. 2, a tube 10*a* with an inside diameter of 7.5 mm will be assumed in whose cross section a bundle of parallel, circular rods 30 with a length of 50 mm is introduced in the number permitted by the rod diameter. Again, a liquid nicotine preparation in a volume of 6 $mm^3$ is distributed uniformly on the entire surface of such a carrier device 24. Table 3 shows the resulting geometric conditions for different rod radii (rod diameter 2.4, 2 and 1.5 mm). Again, the included circle radius between three rods 30 touching each other is reported for size comparison with the calculated layer thickness (not drawn in FIG. 2, C.)

TABLE 3

| | | (loading: 6 $mm^3$) | | |
|---|---|---|---|---|
| rod radius [mm] | number of rods | total surface [$mm^2$] | layer thickness [μm] | included circle radius [μm] |
| 1.2 | 7 | 2639 | 2.3 | 186 |
| 1 | 9 | 2827 | 2.1 | 155 |
| 0.75 | 19 | 4477 | 1.3 | 116 |

It shows that completely similar values in magnitude result a with the carrier device according to FIG. 1 formed from a spherical packing. The included circle radius amounts to a multiple of the calculated layer thickness, i.e. the cross section of channels 31 remains wide opened and the capillary action in the "protruding corners" of channel 31 (in each case on both sides of a contact line between two rods 30) remains low. From this, it is also clear that the arrangement—also of all remaining carrier devices described here—has nothing in common with a porous material which absorbs a liquid and is TM saturated"by it. This also can he recognized easily if the total free volume formed by the flow channels 31 or the volume not taken up by rods 30 is calculated. With a rod diameter of 2.4 mm and the remaining dimensions used as basis of Table 3, this amounts to 625 $mm^3$, therefore approximately one hundred times the volume of the nicotine preparation provided for the charging. Also—as already explained - the choice of the material for the carrier device determines that the nicotine preparation at the structure surface remains an applied layer and does not diffuse into the inside of the material and is not absorbed by the material.

Also with a carrier device according to FIG. 2, the nicotine volatilization in the air being drawn through the device at room temperature can be achieved at values which are comparable in degree and in chronological course to values as have been discussed with use of Table 2.

With regard to the nicotine preparation being introduced, it should be mentioned that other possibilities exist in addition to the previously mentioned pure nicotine. In particular, it may be desirable that the article contain flavoring materials, for example tobacco taste, fruit flavors, mint or the like. Which will be inhaled together with the volatilized nicotine. Such flavoring materials and/or other additives can be mixed into the pure nicotine liquid and the mixture introduced into the carrier device as the nicotine preparation. Tobacco flavoring oil known per se is merely mentioned as an example which is suitable for mixing with pure nicotine.

However, it may also be suitable to arrange flavoring materials or the like in a separate carrier in addition to the carrier device in the container. Such a separate flavoring carrier is depicted in FIG. 2 schematically as an air-permeable "plug" 26, for example, a cigarette filter material or the like. Such a carrier 26 is suitably arranged with respect to the flow direction of the air; in the container before carrier device 24. An arrangement behind the carrier device appears less suitable since then a part of the volatilized nicotine introduced into the air stream could be absorbed again in the material of carrier 26.

An additional embodiment of an article according to FIG. 3 comprises a container 10*b* with mouthpiece 13, air intake opening ii and air delivery opening 12 similar to that of FIG. 1. However, a self-supporting, cylindrical object is arranged in container 10*b* as a carrier device 34 for a nicotine preparation. For example, this involves a rigid, open-celled foam object with a structure that is apparent from the greatly enlarged in FIG. 3 D. The cavities or "cells" 36 distributed inside the object are connected to one another at numerous points and form a plurality of flow channels 37, which pass through the carrier device 34 and also are "cross-linked" with each other in a variety of ways. Also, a nicotine preparation capable of volatilizing at room temperature is applied here on the entire surface of cells 36 or channels 37 as a thin layer leaving the channels open (the layer is not depicted in FIG. 3). As in the carrier devices described above. The carrier device 34 also must be impervious at least on its surface (surfaces of the cells 36 or channels 37), i.e. be nonabsorbent. Again, glass is suitable above all as the material.

An open-celled foam object with an internal structure approximately according to FIG. D can also be perceived as a "positive-negative inversion" of a spherical packing, i.e. the open cells or "bubbles" of the foam assume the positions of spheres in the spherical packing. In this case, the total surface of the bubbles probably is somewhat lower than would be attainable with a spherical Packing (sum of sphere surface areas). On the other hand, in general, almost no projecting corner areas and thus no capillary action occurs in the foam structure.

An object usable as carrier device 34 can also be produced as a sintered object from a packing of spheres or granules of identical or differing grain size. The structural properties of the object can be adjusted as necessary Within wide limits by appropriate choice of grain size, grain size distribution and Process parameters during sintering. The same is also true for the preparation of open-celled foam objects. Such structural properties (average pore size, nature of flow channels etc.) can be significant for introduction of the nicotine preparation and its distribution on the surface, particularly however for the flow resistance of the carrier device during passage of air. So-called open-pored sintered glass, Which can be prepared with specifically adjusted structural parameters and in the desired external shape, has proved to he very suitable material for the carrier device 34. An average pore size in a range approximately between 150 and 300 μm and a pore volume of approximately 50% to 80% are mentioned merely as examples. Such a product is free of binders and substantially inert, and exhibits a large specific surface which is easily wetted by the nicotine preparation Inhalable nicotine amounts in the magnitude of 12 μg to 16 μg during the first 100 to 150 puffs can be achieved with a cylindrical plug of this type having an 8.5 mm diameter and 10 mm length charged with 4 mg pure nicotine.

FIG. 4, in somewhat larger scale than earlier, shows an additional embodiment which differs from that according to FIGS. 1 through 3 primarily in the external shape of the carrier device and the flow conditions resulting from this shape. A carrier device 44 in the form of a cylindrical tube, indicated by cross hatching, is arranged within a cylindrical container 10c having an air intake opening ii and a delivery passage 12. The end of the tube adjacent to the container opening 11 is sealed by a disk 43 and is centered between several support ribs 41 molded inside the housing 10c and distributed about its circumference. The other end of the tube is held by a support 42 surrounding the passage 12 and is also centered by this support. In this manner a flow path, as indicated by several wavy lines, results upon drawing air through the device in the direction of the arrow, i.e. air passes through the carrier device 44 essentially radially to the longitudinal axis. One of the materials described in connection with FIG. 3 can be used as the material with a plurality of flow channels, and the earlier statements apply with regard to coating the surface of the flow channels. However, the flow paths are considerably shortened in the present design compared to the carrier devices of the preceding example. In contrast to this, the air passes through a substantially larger effective cross sectional area of the carrier device which area corresponds essentially to the product of the length of the tube and its average diameter. As can be readily seen, the flow resistance and the available total surface area of the flow channels can be adjusted extensively independent of each other by variation of the tube diameter, the wall thickness and the length of the carrier device. (It will be mentioned mere)y as information that the flow resistance of various cigarette brands varies within wide limits between approximately 35 and 120 mm of water.)

It is still to be explained that the charging of the carrier devices with the nicotine preparation can be carried out rather simply in large scale production. Preferably, the carrier devices are supported with their axes vertical and a measured liquid volume is introduced by a dosing apparatus known per se from a closed container through one of the surface walls o: the device (with the cover 16 removed in device 14 according to FIG. 1). It is shown that the liquid preparation by virtue of its good wettability spreads out rapidly over the surface of the flow channels and relatively soon penetrates through to the opposite surface wall of the device. Particularly in the case of a loose granulate or spherical packing, slightly shaking or vibrating promotes spreading of the liquid. The charging of the carrier device according to choice can be carried out before or after installation in the container. In each case, a separate preparation and "finishing" of the carrier device suitably can be completely independent of the container for large scale production.

For the carrier device in each case, the material, as already mentioned before, will be at least so dense on the surface that the nicotine preparation is not absorbed. In addition to glass, also chemically resistant and dense metals or metal alloys, for example aluminum, come into consideration as materials. Also, structures of dense and/or glazed ceramic also come into consideration. Finally, also special plastics that are known to be particularly dense or impermeable Would be conceivable, such as, for example polytetrafluoroethylene (Teflon) or poly(butyleneterephthalate). Naturally, it is also conceivable to Produce the carrier device from a combination of two or even more of the aforementioned materials.

We claim:

1. An article for simulation of smoking by inhalation of nicotine Without the action of heat comprising, a container defining an air inlet opening and an air outlet opening, a carrier device mounted inside the container and holding a nicotine preparation capable of volatilizing at room temperature, characterized in that the carrier device (14, 24, 34, 44) essentially fills up the effective cross section of container (10), and defines a plurality of uninterrupted flow channels (21, 31, 37) on whose free and nonabsorbent surface the nicotine preparation is applied as thin layer (22, 32) leaving the channels open.

2. An article according to claim 1, characterized in that the carrier device (14, 24, 34, 44) consists essentially of glass.

3. An article according to claim 1, characterized in that the carrier device (14, 24, 34, 44) is comprised of an impervious, chemically resistant metal or metal alloy, such as aluminum.

4. An article according to claim 1, characterized in that the carrier device (14, 24, 34, 44) is comprised of impervious and/or glazed ceramic.

5. An article according to claim 1, characterized in that the carrier device (14, 24, 34, 44) is comprised of a nonabsorbent and chemically resistant plastic.

6. An article according to claim 1 characterized, in that the carrier device (14, 24, 34, 44) is comprised of at least two of the materials selected from the group consisting of glass, an impervious chemically resistant metal, an impervious, chemically resistant metal alloy, an impervious ceramic, a glazed ceramic and a nonabsorbent and chemically resistant plastic.

7. An article according to claim 1, characterized in that the carrier device (14) is comprised of a packing of granulate material.

8. An article according to claim 7, characterized in that the granulate particles are spheres (20).

9. An article according to claim 1, characterized in that the carrier device (24) is comprised of a bundle of essentially parallel rods (30) with interposed longitudinal channels (31).

10. An article according to claim 9, characterized in that the rods (30) have a circular cross section.

11. An article according to claim 1, characterized in that the carrier device is comprised of an open-pored sintered object.

12. An article according to claim 1, characterized in that the carrier device is comprised of a rigid, open-celled foam object.

13. An article according to claim 11, characterized in that the sintered or foam object is cylindrical.

14. An article according to claim 11, characterized in that the sintered or foam object is tubular.

15. An article according to claim 1, characterized in that the container (10) contains flavoring material in addition to the nicotine preparation.

16. An article according to claim 15, characterized in that the flavoring materials are present in a carrier (26) adjacent to the carrier device (24).

17. An article according to claim 1, characterized in that the nicotine preparation is pure nicotine.

18. Carrier device for use in an article for simulation of smoking by inhaling nicotine without the use of heat, characterized by an active section comprised of nonabsorbent material, at least at the surface, and forming a plurality of open channels (21, 31, 37) on whose free surface a nicotine preparation capable of volatilizing at room temperature is applied in a thin layer (22, 32) leaving the channels open.

19. Carrier device according to claim 18, characterized in that the active section consists essentially of glass.

20. Carrier device according to claim 18, characterized in that the active section is comprised of a chemically resistant, impervious metal or metal alloy, such as aluminum.

21. Carrier device according to claim 18, characterized i that the active section is comprised of impervious and/or glazed ceramic.

22. Carrier device according to claim 18, characterized in that the active section is comprised of a nonabsorbent and chemically resistant plastic, particularly polytetrafluoroethylene.

23. Carrier device according to claim 18, characterized in that the active section is composed of at least two of the materials selected from the group consisting of glass, a chemically resistant impervious metal, a chemically resistant impervious metal alloy, an impervious ceramic, a glazed ceramic and a non-absorbent and chemically resistant plastic.

24. Carrier device according to claim 18, characterized in that the active section is comprised by a packing of granulate particles coated with the nicotine preparation.

25. Carrier device according to claim 24, characterized in that the granulate particles are spheres (20).

26. Carrier device according to claim 18, characterized in that the active section is comprised by a bundle of essentially parallel rods (30), which are coated with the nicotine preparation, with interposed longitudinal channels (31).

27. Carrier device according to claim 26, characterized in that the rods (30) have a circular cross section.

28. Carrier device according to claim 18, characterized in that the active section is comprised by an open-pored sintered object.

29. Carrier device according to claim 18, characterized in that the active section is comprised by a rigid, open-celled foam object (34).

30. Carrier device according to claim 28, characterized in that the sintered or foam object is cylindrical.

31. Carrier device according to claim 28, characterized in that the sintered or foam object is tubular.

* * * * *

UNITED STATES PATENT AND TRADEMARK OFFICE

CERTIFICATE OF CORRECTION

PATENT NO. : 5,101,838

DATED : April 7, 1992

INVENTOR(S) : Schwartz, et al.

It is certified that error appears in the above-identified patent and that said Letters Patent is hereby corrected as shown below:

Col. 3, line 45, delete "FIG. 1 (A-C shows" and substitute --Figures 1A, 1B and 1C show--. Line 49, delete "FIG. 2 (A and B) is" and substitute--Figures 2A and 2B are--. Line 53, delete "FIG. 3 (A and B) shows" and substitute --Figures 3A and 3B show--. Line 64, delete "1" and substitute--1A--.

Col. 4, line 47, delete "1 and designated by A" and substitute--1B--. Line 53, delete "A" and substitute--in Fig. 1B--. Line 53, delete both occurrences of "view B" and substitute--Fig. 1C--. Line 56, delete "B" and substitute--of Fig. 1C--.

Col. 5, line 13, delete "1, B" and substitute--1C--. Line 47, delete "i B" and substitute--1C--. Line 63, delete "1" and substitute--1A--.

Col. 6, line 53, delete "2" and substitute--2A--. Line 60, delete "c" and substitute--in Fig. 2B--. Line 62, delete "Plurality" and substitute--plurality--.

UNITED STATES PATENT AND TRADEMARK OFFICE

CERTIFICATE OF CORRECTION

PATENT NO. : 5,101,838

DATED : April 7, 1992

INVENTOR(S) : Schwartz, et al.

It is certified that error appears in the above-identified patent and that said Letters Patent is hereby corrected as shown below:

Col. 7, line 10, delete "2 C" and substitute--2B--. Line 16, delete "2" and substitute--2A--. Line 27, delete "2, C" and substitute--2B--. Line 38, delete "1" and substitute--1A--. Line 61, delete "2" and substitute --2A--.

Col. 8, line 14, delete "2" and substitute--2A--. Line 25, delete "3" and substitute--3A--. Line 27, delete "1" and substitute--1A--. Line 32, delete "3 D" and substitute--3B--. Line 40, delete "3" and substitute--3A--. Line 46, delete "D" and substitute--3B--.

Col. 9, line 33, delete "3" and substitute--3A--. Line 59, delete "1" and substitute--1A--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*